United States Patent [19]

Holic

[11] 4,309,159

[45] Jan. 5, 1982

[54] REFRACTORY NOZZLE

[75] Inventor: John F. Holic, Monaca, Pa.

[73] Assignee: Crucible Inc., Pittsburgh, Pa.

[21] Appl. No.: 156,721

[22] Filed: Jun. 5, 1980

[51] Int. Cl.[3] ..... B22F 9/00

[52] U.S. Cl. ..... 425/7; 264/12

[58] Field of Search ..... 425/7; 264/12

[56] References Cited

U.S. PATENT DOCUMENTS 2,968,062 1/1961 Probst et al. ..... 425/7

4,243,400 1/1981 Ohsato et al. ..... 425/7

*Primary Examiner*—James R. Hall

*Attorney, Agent, or Firm*—Clair X. Mullen, Jr.

[57] ABSTRACT

An improved refractory nozzle for use with a tundish in the atomization of molten metal to produce metal particles for powder metallurgy applications. The nozzle is constructed from refractory material and has a metal sleeve surrounding the nozzle bore near the discharge end thereof but offset a distance from the bore. The metal sleeve minimizes cracking caused by the thermal gradient resulting from molten metal passing through the nozzle to heat the nozzle interior to a temperature higher than the nozzle exterior at the tip.

5 Claims, 3 Drawing Figures

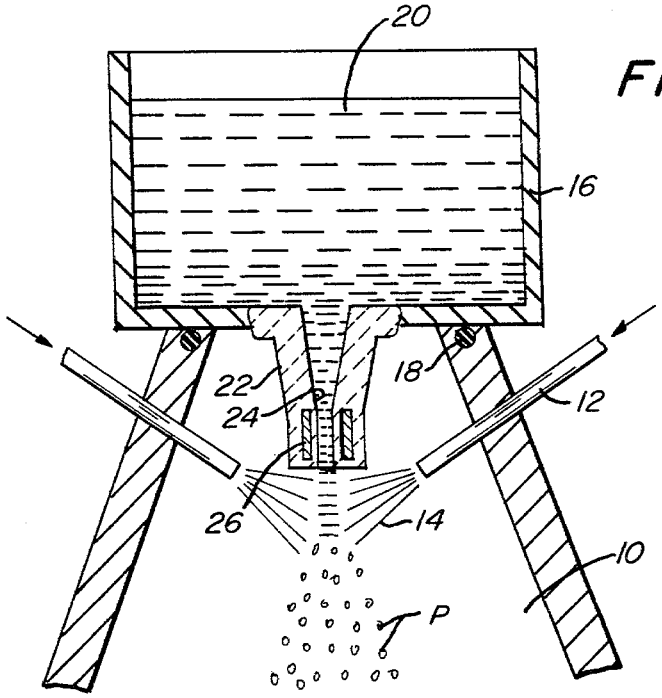
FIG. 1
FIG. 2
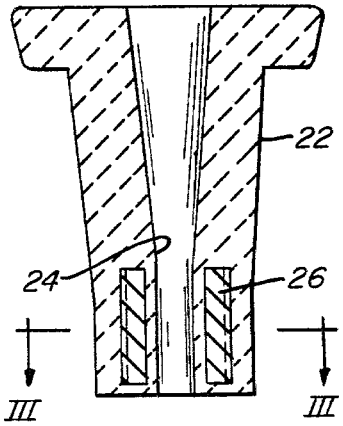
FIG. 3
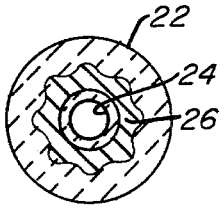

REFRACTORY NOZZLE

It is customary in powder metallurgy applications to produce powders for compaction by striking a stream of molten metal with a gas jet, such as nitrogen, whereby the molten stream is atomized to form the particles. The particles are quickly cooled to solidify the same for subsequent handling and use. Atomizing apparatus suitable for this purpose includes a tundish adapted to set atop an atomizing chamber. The tundish conventionally has a refractory nozzle extending into the atomizing chamber with the end of the nozzle being adjacent a gas jet or jets. As the molten metal exits from the nozzle the gas jets are directed onto it to atomize the molten metal and the atomized metal particles drop downwardly in the chamber and are solidified and collected in the chamber bottom. To facilitate cooling and prevent agglomeration of the particles it is customary to have a bath of water or cryogenic liquid in the chamber bottom within which the particles are collected.

It has been found that the molten metal stream passing through the nozzle interior causes a drastic temperature differential between the interior and the exterior of the nozzle, which results in cracking of the nozzle due to thermal shock. If cracking occurs the atomizing gas then passes through the crack and into the nozzle to contact the molten metal passing therethrough. This causes cooling of the metal within the nozzle and thus buildup of solidified metal within the nozzle. This metal buildup within the nozzle results in poor atomization and if it becomes extreme it can restrict totally the passage of metal through the nozzle so that atomization must be discontinued until the nozzle is cleaned or replaced. This is commonly termed "nozzle freeze-up".

It is accordingly an object of the present invention to provide an improved nozzle for use in metal atomizing operations wherein cracking of the nozzle tip due to thermal shock is minimized and to provide a shield in the event of cracking to prevent gas from contacting the molten metal passing through the nozzle.

This and other objects of the invention as well as a more complete understanding thereof may be obtained from the following description, specific examples and drawings, in which:

FIG. 1 is a schematic showing in vertical cross-section of a portion of atomizing apparatus embodying the nozzle of the invention;

FIG. 2 is a vertical cross-section of the nozzle of the invention; and

FIG. 3 is a horizontal section through a portion of the nozzle of FIG. 2 at III—III thereof.

Broadly, in the practice of the invention the apparatus with which the improved nozzle is used includes a conventional tundish adapted to contain molten metal to be atomized. The tundish, which is removable, is positioned during operation atop the atomizing chamber. Depending from the tundish bottom is a refractory nozzle; it is an improved nozzle structure that is the subject of the invention. The nozzle extends into the atomizing chamber and has a longitudinal through passage. Within the atomizing chamber there is at least one jet adapted to deliver atomizing gas onto the molten metal as it discharges from the end of the nozzle passage. By the action of the jet the molten metal discharging from the nozzle passage is atomized as it enters the atomizing chamber. In accordance with the present invention the refractory nozzle is provided with a metal sleeve that is fixed within the refractory nozzle and surrounds, but is off-set from, a longitudinal portion of the nozzle passage nearer the end thereof extending into the atomizing chamber but preferably offset a distance from the end. The nozzle sleeve may be offset a distance of 1/32 in. to $\frac{1}{8}$ in. from this nozzle end. In addition, preferably the sleeve is constructed from steel and is fluted. Typically, the refractory of the nozzle may be $Al_2O_3$; however, other refractory material may be employed. The metal sleeve may be of various configurations but if it is fluted longitudinally this adds to the strength of the portion of the refractory nozzle tip embodying the sleeve. It is preferred that the sleeve terminate short of the nozzle end so that it is completely encased in the refractory of the nozzle and out of contact with the molten metal passing through the nozzle.

With respect to the drawings, there is shown one embodiment of the nozzle of the invention used in conjunction with a typical gas atomizing apparatus shown in FIG. 1. The apparatus includes a conventional atomizing chamber 10, only the top portion of which is shown in the drawing, having two jets 12 for discharging atomizing gas 14 into the chamber. Tundish 16 which is portable, is shown in the operating position atop the chamber 10 and in sealing engagement therewith by means of "O" ring seal 18. The tundish contains a quantity of liquid metal 20, which exits into the chamber through a refractory nozzle 22 constructed in accordance with the invention. The refractory nozzle 22, as best shown in FIGS. 2 and 3, has a converging bore or through passage 24. Near the end of this passage within the atomizing chamber is an insert constituting a metal ring or sleeve 26. The sleeve exterior is longitudinally fluted, as best shown in FIG. 3. In addition the sleeve 26 is offset a distance from the tip of the nozzle so that it is completely encased in the refractory of the nozzle. In the drawings the sleeve 26 is shown larger than scale for clarity of illustration.

In the operation of the atomizing apparatus shown in the drawings, metal from the tundish 20 exits to the atomizing chamber through the nozzle and is struck by the jets of inert gas 14 to form atomized particles, which are designated in FIG. 1 as "P".

A portion of the gas strikes the nozzle tip and has a cooling effect on the exterior thereof. With the heat from the molten metal passing into the nozzle this creates a temperature differential across the tip of the nozzle. This differential, as earlier explained, results in cracking of the refractory of the nozzle tip due to thermal shock. The metal sleeve within the refractory nozzle tip minimizes cracking by reinforcing and strengthening the refractory of the nozzle tip.

By way of specific example and to compare nozzles constructed in accordance with the invention, e.g. having stainless steel sleeves embedded in the refractory nozzle tip, with conventional nozzles of the same refractory material without these sleeves, thermal cracking tests were run on ten nozzles using an acetylene torch to heat the bore to simulate the thermal conditions existing in an atomizing operation. The nozzles were made from $Al_2O_3$ and have a $\frac{1}{2}$ in. bore $\times$ $1\frac{1}{4}$ in. O.D. A 0.010 in. thick $\times$ $\frac{3}{4}$ in. long corrugated stainless steel sleeve was inserted parallel to the bore, 1/16 in. from the exit end of five of the nozzles.

To insure impartial testing, identification marks, placed on the shoulder end of the nozzles, could not be seen during the test run. The ten nozzles were randomly placed in a preheating furnace at 300° F. They were then tested one by one by removing them from the furnace and heating the bore with an acetylene torch and visually observing any cracking.

Test results were as follows:

| Nozzle No. | No. of Cracks | Time to Crack (Seconds) | Total Torch Time (Minutes) |
|---|---|---|---|
| | | .010" Corrugated Sleeve | |
| 5 | 0 | — | 1 |
| 7 | 0 | — | 1 |
| 8 | 0 | — | 1 |
| 9 | 0 | — | 1 |
| 10 | 1 | 20 | 1 |
| | | No Sleeve | |
| 1 | 2 | 7,26 | 1 |
| 2 | 1 | 7 | 1 |
| 3 | 1 | 10 | 1 |
| 4 | 1 | 14 | 1 |
| 6 | 1 | 21 | 1 |

It was seen from visual observation of the nozzles of the aforementioned tests that the cracking observed was similar to that observed under actual service conditions in gas atomizing operations. The cracking observed in nozzles without metal sleeves was relatively severe and of a character that would have admitted quantities of gas to the nozzle bore sufficient to impair or stop completely the passage of molten metal therethrough. The one nozzle with a sleeve that did crack exhibited only one very fine crack.

I claim:

1. In an apparatus for producing powdered metal by gas atomization which apparatus includes a tundish for containing molten metal to be atomized, said tundish resting atop an atomizing chamber, a refractory nozzle depending from said tundish and extending into said atomizing chamber said nozzle having a longitudinal through passage, and at least one jet adapted to direct gas onto molten metal discharged from said nozzle passage and into said atomizing chamber to atomize said molten metal, the improvement comprising a metal sleeve fully encased within said refractory nozzle and surrounding a longitudinal portion of said nozzle passage nearer the end thereof extending into said atomizing chamber whereby said sleeve structurally reinforces said nozzle against failure due to thermal shock therein.

2. The apparatus of claim 1 wherein said sleeve is offset a distance from said nozzle end.

3. The apparatus of claim 1 wherein said sleeve is offset a distance of 1/32 in. to ⅛ in. from said nozzle end.

4. The apparatus of claim 1 wherein said sleeve is constructed from steel.

5. The apparatus of claim 1 wherein said sleeve is fluted.

* * * * *